United States Patent [19]

Ohara et al.

[11] Patent Number: 4,855,280

[45] Date of Patent: Aug. 8, 1989

[54] DEVELOPER SHEET

[75] Inventors: Shuzo Ohara, Kawanishi; Hiroshi Kawahara, Tondabayashi, both of Japan

[73] Assignee: Goyo Paper Working Co. Ltd., Osaka, Japan

[21] Appl. No.: 184,633

[22] PCT Filed: Jul. 29, 1987

[86] PCT No.: PCT/JP87/00554

§ 371 Date: Mar. 31, 1988

§ 102(e) Date: Mar. 31, 1988

[87] PCT Pub. No.: WO88/00890

PCT Pub. Date: Feb. 11, 1988

[30] Foreign Application Priority Data

Jul. 31, 1986 [JP] Japan ..... 61-181646
Jul. 21, 1987 [JP] Japan ..... 62-183185

[51] Int. Cl.[4] ..... B41M 5/16; B41M 5/18

[52] U.S. Cl. ..... 503/214; 427/150; 427/151; 428/513; 428/913; 428/914; 503/207

[58] Field of Search ..... 427/150–152; 428/913, 914, 513; 503/200, 207, 214, 226

[56] References Cited

U.S. PATENT DOCUMENTS 4,286,017 8/1981 Nakamura et al. ..... 503/225
4,321,092 3/1982 Cespon ..... 503/225
4,740,494 4/1988 Watanabe et al. ..... 503/206

FOREIGN PATENT DOCUMENTS 61-148094 7/1986 Japan ..... 503/214

*Primary Examiner*—Bruce H. Hess
*Attorney, Agent, or Firm*—Sughrue, Mion, Zinn, Macpeak & Seas

[57] ABSTRACT

The present invention provides a developer sheet composed of a sheet-like molded form of a mixture of a developer and a dye-adsorbing inorganic substance and a substrate integrated by adhesion. According to the present invention, there is provided a developer sheet improved in color coupling performance, outstanding in stability (to water, heat, light, plasticizer etc.) and manufacturable with a high efficiency.

5 Claims, No Drawings

DEVELOPER SHEET

This invention relates to a novel developer sheet, and more particularly to a developer sheet composed of a sheet-like molded form of a developer-containing resin and a substrate.

TECHNICAL BACKGROUND

Noncarbon papers are roughly divided into the so-called transfer type in which the color coupler microcapsule and developer are separately coated on different papers and the self-contained type in which they are applied in two layers on paper surface or coated as a mixture. Since such coating methods, in which water or solvent-based liquids are coated on paper, are likely not only to be problematic with regard to working environment but also is accompanied by the risk of fire or explosion and, furthermore, a drying process is required to make the whole process to be complicated and a lot of energy to be required. A method for solving this problem is proposed, for example, in Examined Publication No. 7917/82. The method is for coating paper with a solid meltable coating composition by the roller or knife coating method or by gravure printing method, but the coating work is not necessarily easy, and has a demerit of requiring a large amount of developer.

The heat sensitive paper being used in large quantities for facsimile etc. has coated thereon a leuco dye and a developer and has a drawback of "base color" tinting or recording image being discolored or fading through contact of "color coupler" layer with chemicals, being thus low in chemical resistance. When it is used for, especially, POS label, importance is attached to anti-plasticizer resistance and proposed is use of over-coating method or the like for prevention of migration of plasticizer. Now heat transfer type recording paper, in which a transfer sheet coated with a layer of leuco dye and a "receiving" sheet coated with a layer of developer are used, is being developed but like the above-described non-carbon paper, this is prepared by coating paper with a liquid such as water or a solvent, hence has problems like non-carbon paper.

The present inventors, therefore, proposed earlier a developer sheet formed by integrating a sheet-like formation composed of an olefin resin and a developer and a substrate (Non-examined publication No. 148094/86).

The above-mentioned defect was eliminated by development of the aforesaid developer sheet and the performance of separate-type pressure sensitive lower paper (resistance to water, oil) was improved markedly, but there was something to be desired about light fastness and fading with time after development.

With regard to the above-mentioned situation and as a result of their intensive studies, the present inventors arrived at the invention through recognition of marked effect of dye-absorbing inorganic substance on the developing performance such as light fastness and fading with time after development.

DISCLOSURE OF THE INVENTION

The present invention relates to a developer sheet obtained through integration of sheet-like formation composed of a mixture of olefin resin, developer and dye-absorbing inorganic with the substrate.

BEST FORM FOR EMBODYING THE INVENTION

As olefin resin according to the present invention best suited are, among others, polyethylene, polypropylene, their copolymers and blends. It is sometimes possible that with some of the olefin resins a further improvement in color coupling performance can be attained by adding an olefin resin containing functional groups. When it is used for pressure-sensitive lower paper, the addition of an olefin resin containing functional groups has an effect for enhancing penetration of the leuco dye-containing capsule oil into the developer sheet, which, in turn, increases the color coupling speed and color coupling concentration. It is also effective for improving the adhesion when it is bonded with the substrate. As olefin resin containing functional group effective are, among others, ethylene-methyl methacrylate copolymer, ethylene-ethylacrylate copolymer, ethylene-acrylic acid copolymer and ethylene metacrylic acid copolymer. The recommended ratio of functional groups ranges from 2 weight % to 30 weight % with the quantity of the entire resin including olefin resin as 100 weight %. If it is less than 2 weight %, no improvement in color coupling performance can be hoped for, while, if it is more than 30 weight %, marked is penetration into and diffusion in the resin of the dye after color coupling, this resulting in loss of sharpness of the developed color image and marked drop in color-coupled concentration.

As developers according to the present invention there is no limitation, in particular, and any of those known is usable e.g. inorganic solid acids such as silica, silica-alumina, silica-magnesia, bentonite, kaolin, acidic clay, active clay, monmorilonite and attapulgite; novolak- type phenol resin, 2,2-bis (4'-oxyphenyl) propane (bisphenol A), 4,4'-secondary buthylidene diphenol (bisphenol B); metal salts of aromatic carboxylic carboxylic acids such as m- or p-zinc hydroxy-benzoate, zinc salicylate, zinc 3-tertiary butyl salicylate, zinc 3,5-ditertiary butyl salicylate, zinc 3-phenylsalicylate and zinc 2 hydroxy-3-naphthoate, but zinc 3,5-ditertiary butylsalicylate is particularly excellent in color coupling performance when it is used for the lower paper of pressure sensitive type. Bisphenol A is particularly suited as color coupler for the lower paper of heat sensitive type. Such developers may be used either alone or in combination, but suited is combination of organic and inorganic developers.

Developer for the lower paper of heat sensitive type may as well be used in combination with a sensitizer such as p-benzyl biphenyl and amid stearate.

Although the mixing ratio for olefin resin and developer cannot be generally determined as it depends on the kind of olefin resin and developer used as well as the degree of color coupling, for 100 weight parts of olefin resin, the quantity of developer may range from 1.0 to 30.0 weight parts, and more preferably be in a range of 5–10.0 weight parts. If it is more than 30.0 weight parts, it may become difficult to obtain a sheet-like form by extrusion molding, while, if it is less than 1.0 weight part, no sufficient color coupling can be hoped for. For preparation of the lower paper of pressure sensitive type addition of a tackifier is effective effective for increasing the depth of color coupled.

As tackifier according to the present invention any of those known is usable, but preferred are those easily soluble in capsule oil for the upper paper and not interfering with color coupling reaction Suited for the purpose are, for example, hydrogenated terpene resin such as "Clearon" (commercial name, manufacturer: Yasuhara Yushi K.K.) and alicyclic saturated hydrocarbon resin such as "Arcon" (commercial name, manufacturer: Arakawa Kagaku K.K.).

As effects of tackifier may be cited acceleration of color coupling reaction between leuco dye and developer and formation of fine cracks in the surface of the developer sheet under pressure for inward expansion of color coupling zone. The proportion of addition of the tackifier, which depends on the kind thereof, is in a range of 20–150 weight parts for 100 weight parts of olefin resin. If it is less than 20 weight parts no improvement in color coupling is attainable, while, if it is more than 150 weight parts, it results in undue drop of the melt viscosity of the mixture as a whole, this interfering with further processing.

As dye-adsorbing inorganic substances according to the present invention, any of those being used as fillers for resins or as developers. They are, among others, silica, silica-alumina compounds, calcium carbonate, mica, talc, titanium dioxide, zeolite, bentonite, barium sulfate, glass powder, active clay, acidic clay, ordinary clay, magnesium silicate etc.

The primary object of using the above-mentioned inorganic substances is prevention of penetration into and/or diffusion in the developer sheet of the color coupling dye. Since the coupled dye tends to migrate and diffuse progressively with time, the color developed image becomes progressively less sharp, giving rise to blur, and in extreme cases results in loss of color. When the abovementioned inorganic substance is added, the coupled dye is adsorbed thereto to be fixed thereby, and prevented are the progressive blurring with time of the developed image and/or loss of color. The inorganic substance used for this purpose is desired to be large in specific surface area and high in oil absorption.

The second object of the use thereof is increasing the depth of the coupled color by using an inorganic developer as an inorganic dye adsorber. As such inorganic substance may be included e.g. magnesium silicate and silica-alumina compound.

The third object of the use thereof is attaining the effect of roughened surface through improvement of the surface hardness of the developer sheet when it is used for the lower paper of pressure sensitive type so that the inorganic substance itself contributes to roughening the surface and improving the depth of coupled color.

The fourth object of the use thereof is improving the heat resistance of the developer sheet when it is used for the lower paper of heat sensitive type.

As to the inorganic substance according to the present invention, it is necessary to select its properties according to the purpose of its use, but in any case it is required to be neutral or acidic. The proportion of the inorganic substance per 100 weight parts of olefin resin is in a range of 5–50 weight parts. The desired effect cannot be obtained if its proportion is less than 5 weight parts, while the resin's workability is deteriorated and film formation becomes difficult if it is more than 50 weight parts.

According to the present invention, any of the known color coupling auxiliaries or stabilizers may be used if necessary. With these, the amount added may normally be 2–10 weight parts.

It is preferred to add to the mixture of the present invention an opacifier for increasing the contrast against the coupled color for improving the visibility of pressure sensitive coupled color image. As such opacifier titanium dioxide, calcium carbonate, barium sulfate and fine particles of plastic etc. may be used but particularly suited is rutile titanium dioxide. The recommended amount added of the opacifier is, for instance, 1–20 weight parts per 100 weight parts of olefin resin. If it is more than 20 weight parts, filming of the developer sheet becomes difficult, while no sufficient opacity is attainable if it is less than 1 weight part.

As the substrate according to the present invention, paper, cloth, nonwoven cloth, cellophane, synthetic resin film, metallic foil, synthetic resin film-metallic foil laminate etc. are used.

Sheet-like molded form of the above-mentioned mixture is obtainable by roll-molding, extrusion molding etc. and integration of the above-mentioned molded form and the substrate is feasible by extrusion, adhesion, welding, fusing etc. but most suitable is extrusion-laminating.

According to the present invention, heat treatment is given if necessary. This heat treatment causes migration of the developer to be omnipresent in the surface of the sheet-like molded form of the mixture of olefin resin and developer so that the desired color coupling effect can be attained with a small amount of the developer.

It is desirous to give corona treatment to the developer sheet of the present invention. This corona treatment improves wettability and adhesion performance of the surface of the developer sheet and prevents transfer of the developer to the color coupler-coated paper when a pile of sheets of color coupler-coated paper is "color-coupled" by pressing. The conditions of the corona treatment are the same as those of the corona treatment for improvement of ordinary synthetic resin film, paper etc., a treating with wattage of 50–200 $w/m^2$ being sufficient.

When the developer sheet of the present invention is used as the pressure-sensitive lower paper, it is desirous to give a treatment to make the sheet's surface irregular simultaneously with or after molding thereof. This surface irregularity treatment increases the surface area of the developer sheet, improves the apparent depth of "color coupled" and also improves superficial wetting by the capsule oil. After color coupling it is effective for rubbing-induced obscuring the description made on the surface.

The above-mentioned superficial irregularity-imparting treatment is given e.g. by (a) a method of passing the extruded developer sheet as it is cooled to solidify through between cooled rollers with their surface matt-finished, (b) a method of sand-blasting the sheet's surface before heat treatment, (c) a method press-fusing a film with its surface roughened to the surface of the developer sheet and removing the said film after heat treatment for the film's superficial roughness transferred to the surface of the developer sheet or (d) a method of filming by extrusion the developer sheet or drawing. Of the above-mentioned alternatives, (a) is particularly suited as the treatment can be given simultaneously with manufacture of the developer sheet, and (c) has a merit of being feasible simultaneously with the heat treatment, although it depends on the treating temperature.

When the developer sheet of the present invention is used as receptor sheet in the heat transfer receptor system, the sheet surface is desired to be smoother for better adhesion to the transfer sheet and for better efficiency of heat transfer to be attainable. In this respect a developer sheet smoother in its surface is obtainable by the use of cooling rollers smoother in surface. As stated above, the desired developer sheet having a surface state adapted for a recording system adopted is readily obtained.

Hereinafter there is given a further, detailed description of the present invention citing a number of examples, but the present invention is limited by no means thereby.

EXAMPLE 1

As olefin resin was used 50 weight parts of low-density polyethylene "Milason M-10P (MI=9.5 g/10 min., density=0.917 g/cm$^3$)" (manufacturer: Mitui Petrochemical Industries, Ltd.) and as functional group-containing polyolefin resin were used 50 weight parts of ethylene/acrylic acid ether copolymer resin "NUC-6570 (MI =20 g/10 min., density 0.943 g/cm$^3$, containing 25% ethyl acrylate)" (manufacturer: Nippon Unicar, Ltd.) together with 15 weight parts of natural zeolite "Silton LP-75 (manufacturer: Mizusawa Chemical Industry, Ltd.) as inorganic substance, and 50 weight parts of hydrogenated "Clearon P-125" (Yasuhara Yushi K.K.) as tackifier. These were dry-blended and then melt-blended by the use of a screw extruder (bent-type, 40 mm in diameter, die outlet temperature 160° C.) and the resulting blend was pelletized by the use of a pelletizer.

To the above-mentioned pelletized blend 8 weight parts of 3,5-ditertiary zinc buthylsalicylate "GS-1" (manufacturer: Sanko Kagaku, K.K.) were added as developer, 5 weight parts of zinc stearate as color coupling auxiliary and 3 weight parts of rutile titanium dioxide as opacifier and after dry blending, the blend was extruded by the abovementioned screw extruder and pelletized by the pelletizer. The resulting pellets were dried in a hopper drier for 2 hours at 50° C., molten and extruded through a T-die extruder (40 mm in diameter, T-die outlet temperature 170° C.) in the form of a sheet (20 μm) and press-laminated on the polyethylene surface layer of the substrate [bleached craft paper (60 g/m2) laminated with low-density polyethylene resin film 15 μm], and a developer sheet was thus obtained.

EXAMPLE 2

A developer sheet was obtained in the same way as described in Example 1 except that 50 weight parts of ethylene methyl methacrylate copolymer resin "Acrift WH-401" (MI=20.0 g/10 min., density 0.94 g/cm3, manufacturer: Sumitomo Chemical Co., Ltd.) were used as functional group-containing polyolefin resin.

EXAMPLE 3

A developer sheet was obtained in the same way as described in Example 1 except that 100 weight parts of low-density ethylene resin were used without using the functional group-containing olefin resin.

EXAMPLE 4

A developer sheet was obtained in the same way as described in Example 1 except that 8 weight parts of Bisphenol A were used and "Clearon P-125" was dispensed with.

CONTROL EXAMPLE 1

A developer sheet was obtained in the same way as described in Example 1 except that no functional group-containing olefin resin or inorganic substance was used and the quantity of the low-density polyethylene resin was increased to 100 weight parts.

CONTROL EXAMPLE 2

A commercially available separate-type pressure sensitive lower paper was used for comparison in pressure-sensitive color coupling performance.

CONTROL EXAMPLE 3

A commercially available heat-sensitive paper for facsimile for comparison in heat-sensitive color coupling performance.

Evaluation of pressure-sensitive color coupling performance:

A commercially available separate-type heat-sensitive upper paper "NW40T" (manufacturer: Jujo Paper Co., Ltd.) was placed on the developer-coated side of each of the developer sheets prepared in Examples 1–3, Control example 1 and Control example 2 (commercially available lower paper), and pressure-sensitive color coupling performance was tested by writing thereon with a ball-point pen.

The depths of the coupled colors were compared 5 minutes after color coupling and the results were as shown in Table 1. Each color-coupled sheet was exposed to sunlight (6 hours×2 times=12 hours), and the result of comparison in residual depth of coupled color was as shown in Table 1. Further, to see the change with time of the depth of color coupled, an accelerated test was made in a thermostat (70° C., 65%RH) for a week and the result of comparison thereafter is also shown in Table 1.

In a test on the resistance of the sheet to plasticizer a soft PVC tape was applied to the color-coupled zone and after 6 hours in a thermostat (70° C., 65%RH) comparison was made in the residual depth of color coupled.

Evaluation of heat-sensitive color coupling performance:

10 weight parts of 3-diethylamino-6-methyl-7-anilinofluoran (manufacturer: Yamamoto Kasei K.K., ODB) as leuco dye and 4 weight parts of ethyl cellulose and 10 weight parts of beeswax as a binder were added to 100 ml of methyl- ethyl ketone and were thoroughly dispersed under mixing. The resulting dispersion (suspension) was applied by coating with a Mayer Bar so that a layer is formed to be 10 in dry weight, and it was further dried to prepare a transfer sheet.

The developer layer of the developer sheet according of the present invention prepared in Example 4 was placed on the dye layer of the transfer sheet prepared by the above-mentioned method and, after heating on a heated plate with a surface temperature of 150° C. (pressure 1.0 kg/cm$^2$, pressing time 1 second) and the transfer sheet was removed thereafter.

Then Control example 3 (commercially available heat-sensitive paper for facsimile) was color-coupled by heating under the above conditions without transfer sheet. The color coupled by heating was brilliant black.

Then, the following performance checking was made to see the stability in storage of the coupled color. The result is shown in Table 2.

Water resistance test: Residual depth of color was examined after dipping for 24 hours in tap water.

Light fastness test: Residual depth of color was examined after exposure to sunlight for 6 hours.

Heat resistance test: Residual depth of color was examined after 24 hours in a thermostat (70° C., 65% RH).

Plasticizer test: Residual depth of color was examined after 6 hours in a thermostat((70° C., 65% RH) with a commericially available soft PVC tape applied to the color-coupled side.

TABLE 1

| | Example | | | Control example | |
|---|---|---|---|---|---|
| | 1 | 2 | 3 | 1 | 2 |
| M-10P | 50 | 50 | 100 | 100 | |
| NUC-6570 | 50 | | | | |
| WH-401 | | 50 | | | |
| GS-1 | 8 | 8 | 8 | 8 | ** |
| P-125 | 50 | 50 | 50 | 50 | |
| LP-75 | 15 | 15 | 15 | | |
| Zinc stearate | 5 | 5 | 5 | 5 | |
| $TiO_2$ (Rutile) | 3 | 3 | 3 | 3 | |
| Depth of color coupled | +++++ | +++++ | ++++ | ++++ | +++++ |
| Residual depth of color coupled | +++ | +++ | +++ | ++ | + |
| R.d.o.c.c. with time/acc. test | +++++ | +++++ | ++++ | + * | +++ |
| R.d.o.c.c./plasticizer resist. test | ++++ | ++++ | ++++ | ++ | ++ |

* Oozing of coupled color image occurred.
** Commercially available lower paper.
R.d.o.c.c. = Residual depth of color coupled

TABLE 2

| | Example | Control Example |
|---|---|---|
| | 4 | 3 |
| M-10P | 50 | |
| UNC-6570 | 50 | |
| Bisphenol A | 8 | ** |
| LP-75 | 15 | |
| Zinc stearate | 5 | |
| $TiO_2$ (Rutile) | 3 | |
| Depth of color coupled | +++++ | +++++ |
| Residual depth of color coupled after water test | +++++ | + |
| R.d.o.c.c. after exposure to light | +++++ | ++++ *1 |
| R.d.o.c.c. after heating | +++++ | +++ *2 |
| R.d.o.c.c. after plasticizer resistance test | ++++ | −−− *3 |

*1 The color of paper in the uncoupled area (ground color) was changed to light brown.
*2 The color of paper in the uncoupled area (ground color) was developed in black
*3 The plasticizer transferred to the developed area to result in disappearance of the image which had been developed in black.
** Commercially available heat-sensitive paper for facsimile.

From the result shown in Table 1 it is apparent from Example 3 and Control example 1 that addition of the inorganic substance is effective against change of color with time. Further, from Examples 1 and 2 and Example 3, it is readily understandable that the depth of color coupled is increased when a functional group-containing olefin resin is used and drop of the depth of color coupled after exposure to light as well as after change-with-time acceleration test. The test result shown in Table 2 shows that the heat-sensitive lower paper is superior in stability in storage (especially after water- or plasticizer resistance test) than commercially available heat-sensitive paper for facsimile.

While the commercially available lower paper and heat-sensitive paper for facsimile are easily damaged by external force such as rubbing when it is wetted with water, the developer sheet of the present invention is not easily damaged as it is composed mainly of synthetic resins.

POSSIBILITY OF COMMERCIAL UTILIZATION

As mentioned above, the present invention provides a developer sheet markedly improved in color coupling performance and having an outstanding stability (to water, heat, light, plasticizer etc.). According to the invention, it is possible to provide a sheet-like molded form of a developer containing sheet integrated with a substrate, hence the manufacturing process is simpler than the conventional counterpart, requires no drying step for water or any other solvent, and is safe from fire hazard or explosion or from contamination of working environment by solvent vapor. When the extrusion laminating system is adopted, manufacture of the sheet-like molded form and its integration with the substrate can be done simultaneously, this being highly efficient.

What is claimed is:

1. A developer sheet made by integrating a sheet-like molded form of a mixture of an olefin resin, a developer and a dye-adsorbing inorganic substance with a substrate by means of adhesion.

2. The developer sheet in accordance with claim 1, wherein said substrate is a paper.

3. The developer sheet in accordance with claim 1, wherein said sheet-like molded form is integrated with said substrate by an extrusion laminating system.

4. The developer sheet in accordance with claim 1, wherein said mixture contains an opacifying agent.

5. The developer sheet in accordance with claim 1, wherein said olefin resin is partly comprised of an olefin resin containing a functional group.

* * * * *